US005484069A

United States Patent [19]

Lanning

[11] Patent Number: 5,484,069

[45] Date of Patent: Jan. 16, 1996

[54] PROCESS FOR SELF-DISASSEMBLING A CRAWLER CRANE

[75] Inventor: John M. Lanning, Cato, Wis.

[73] Assignee: The Manitowoc Company, Inc., Manitowoc, Wis.

[21] Appl. No.: 170,682

[22] Filed: Dec. 20, 1993

Related U.S. Application Data

[63] Continuation of Ser. No. 762,767, Sep. 20, 1991, abandoned.

[51] Int. Cl.[6] ..... B66C 23/42; B66C 23/26; B66C 23/70

[52] U.S. Cl. ..... 212/270; 212/177; 212/178; 212/175; 212/299; 212/294

[58] Field of Search ..... 212/175–182, 212/186–188, 192–193, 211, 222, 227, 230–239, 255, 260, 262, 266; 414/607; 52/116

[56] References Cited

U.S. PATENT DOCUMENTS

| | | | |
|---|---|---|---|
| 3,149,730 | 9/1964 | Mork | 212/177 |
| 3,357,573 | 12/1967 | Stukins | 212/183 |
| 3,367,448 | 2/1968 | Wille | 212/183 |
| 3,557,969 | 1/1971 | Heyer | 212/177 |
| 3,624,784 | 11/1971 | Larson et al. . | |
| 4,000,784 | 1/1977 | Morrow, Sr. et al. . | |
| 4,014,400 | 3/1977 | Cline et al. . | |
| 4,195,740 | 4/1980 | Beduhn et al. . | |
| 4,273,244 | 6/1981 | Jensen et al. . | |
| 4,381,060 | 4/1983 | Morrow, Sr. et al. | 212/183 |
| 4,579,234 | 4/1986 | Delago et al. . | |
| 4,601,401 | 7/1986 | Wittman et al. . | |
| 4,632,261 | 12/1986 | Cuhel . | |
| 4,632,262 | 12/1986 | Olsen et al. . | |
| 4,662,527 | 5/1987 | Cuhel . | |
| 4,856,662 | 8/1989 | Marvin et al. | 212/177 |
| 4,892,201 | 1/1990 | Hellwig et al. | 212/186 |

FOREIGN PATENT DOCUMENTS

| | | | |
|---|---|---|---|
| 1525783 | 4/1968 | France | 212/177 |
| 1016916 | 10/1957 | Germany | 212/262 |
| 465807 | 1/1969 | Switzerland | 212/177 |
| 1409577 | 7/1988 | U.S.S.R. | 212/186 |
| 865160 | 4/1961 | United Kingdom | 414/607 |
| 981129 | 1/1965 | United Kingdom | 212/177 |

OTHER PUBLICATIONS

Demag Model TC 3600 Quicklifter Brochure, published by The Mannesmann Demag Baumaschinen Company, publication date unknown.

Link–Belt Model HC–268 Lattice Boom Truck Crane Brochure, published by FMC Corporation, publication date unknown.

Manitowoc Model 3900T Brochure, published by The Manitowoc Company, published date unknown.

Sumitomo Model LS–368RH5 Brochure, published by The Sumitomo Company, publication date unknown.

Manitowoc Model 4100W Brochure, published by The Manitowoc Company, p. 6, published 1972.

Manitowoc M–Series Brochure, published by The Manitowoc Company, published 1990.

*Primary Examiner*—Michael S. Huppert
*Assistant Examiner*—R. B. Johnson
*Attorney, Agent, or Firm*—Willian Brinks Hofer Gilson & Lione

[57] ABSTRACT

A method and apparatus for self-assembling and self-disassembling a large capacity crawler crane. The method uses the load hoist line of a crane to remove the equalizer from the boom. The method also uses a hydraulic cylinder to support, raise and lower the boom after the equalizer has been removed from the boom. Finally, the boom butt can be disassembled into several parts.

15 Claims, 10 Drawing Sheets

PROCESS FOR SELF-DISASSEMBLING A CRAWLER CRANE

This application is a continuation of application Ser. No. 07/762,767, filed Sep. 20, 1991, abandoned.

BACKGROUND OF THE INVENTION

The present invention relates to construction equipment, such as cranes, which must be disassembled into a number of separate components to be transported between job sites, and more particularly to a method and an apparatus for self-assembling and self-disassembling.

Construction equipment, such as cranes or excavators, often must be moved from one job to another. Moving a crane or excavator can be a formidable task when the machine is large and heavy. For example, highway limits on vehicle-axle loads must be observed and overhead obstacles can dictate long, inconvenient routings to a job site.

One solution to improving the mobility of large construction machines, such as cranes, is to disassemble them into smaller, more easily handled components. The separate components can then be transported on separate trailers to the new job site where they are reassembled.

The typical practice has been to use an assist crane to disassemble the crane into the separate components. The assist crane is then used to load the components onto their respective transport trailers. Once at the new job site, another assist crane is used to unload the components and reassemble the crane. As the separate components for a large capacity crane can weigh as much as 80,000 lbs., the capacity of the assist crane required represents a very significant transport expense.

As a result, designers have attempted to develop self-handling systems for assembling and disassembling cranes. However, self-handling systems developed thus far have been limited to smaller capacity cranes which need to be disassembled into only a few components. Self-handling systems for larger capacity cranes, which must be disassembled into numerous components, have yet to be developed. The primary reason for this is that the boom on a larger capacity crane must be unrigged and disassembled from the crane, thus limiting the use of the boom for further disassembly.

Prior art self-handling systems also have the disadvantage of requiring the boom hoist rigging to be unrigged from the equalizer.

SUMMARY OF THE INVENTION

A method and apparatus for self-assembling and self-disassembling a large capacity crawler crane has been invented which overcomes the deficiencies noted above and has other advantages. The method uses the load hoist line of a crane to remove the equalizer from the boom, thus negating the need to unrig the boom hoist rigging. The method also uses a hydraulic cylinder to support, raise and lower the boom after the equalizer has been removed from the boom, thus facilitating further disassembly of the crane. Finally, the boom butt can be disassembled into several parts so that the lower end of the boom butt can remain attached to the upper works.

DETAILED DESCRIPTION OF THE PREFERRED EMBODIMENT

The preferred embodiment of the present invention relates to a self-assembling crane, other aspects of which are disclosed in the following co-pending applications assigned to the assignees of the present application, being filed concurrently herewith unless otherwise specified:

"Multi-Coupling Device for Crane Hydraulic Lines," Ser. No. 07/762,771, now U.S. Pat. No. 5,148,429;

"Quick-Connect Sectional Boom Members for Cranes and the Like," Ser. No. 07/736,029, now U.S. Pat. No. 5,199,586;

"Crane Upper Works to Lower Works Alignment System," Ser. No. 07/762,765;

"Carbody to Crawler Connection," Ser. No. 07/762,765;

"Easily Removable Sheave Assembly," Ser. No. 07/62,766;

"Control and Hydraulic System for a Liftcrane," Ser. No. 07/418,879, now U.S. Pat. No. 5,189,605; and "Control and Hydraulic System for Liftcrane," filed Aug. 13, 1990 (Ser. No. 07/566,751), a continuation-in-part application Ser. No. 07/418,879.

The crane of the preferred embodiment also uses the swing lock mechanism disclosed in application Ser. No. 07/556,840, now U.S. Pat. No. 5,176,267. Each of these applications is hereby incorporated by reference.

Figure 1:
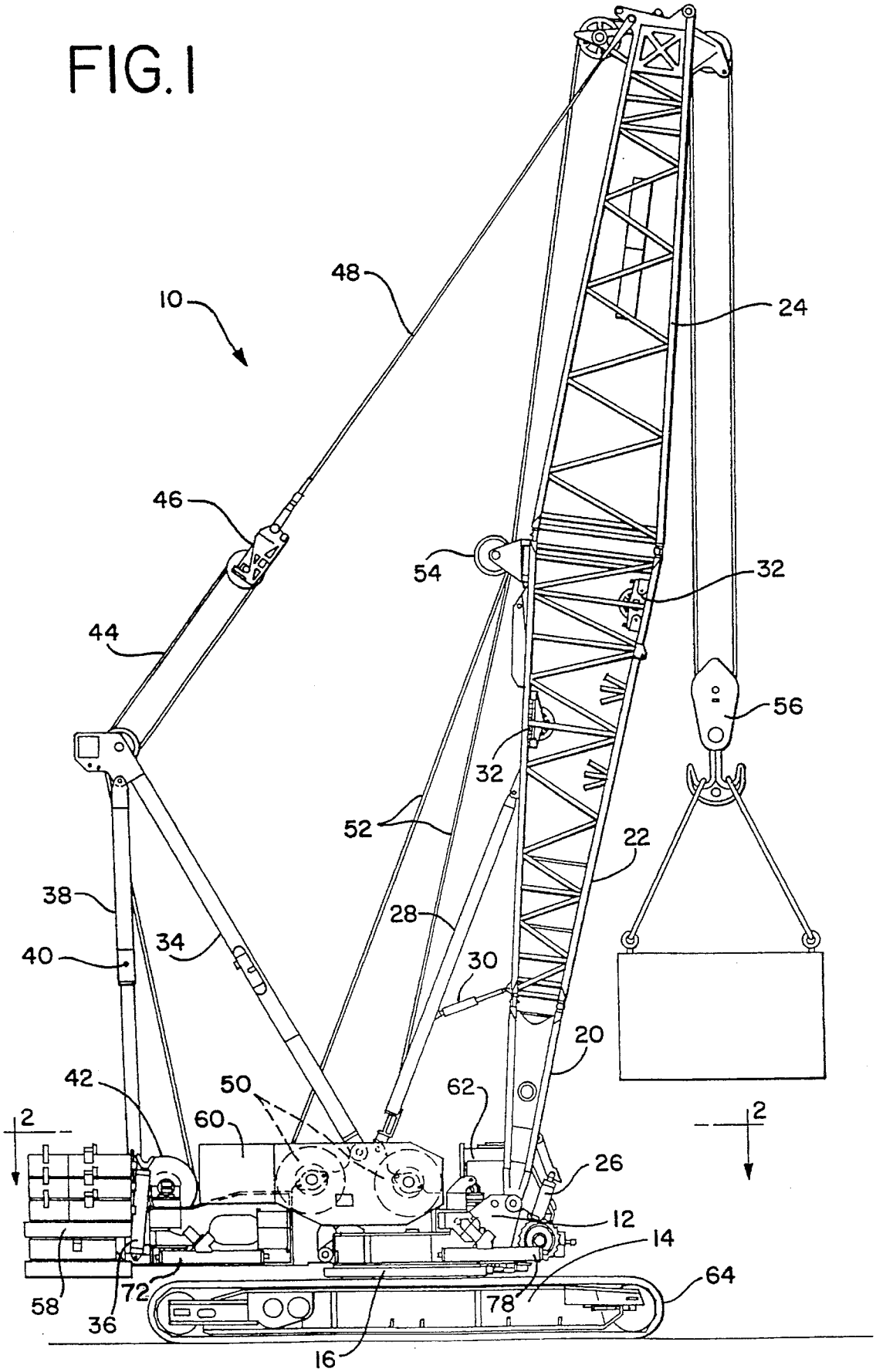
FIG. 1 is a right side perspective view of the complete crane.
Figure 2:
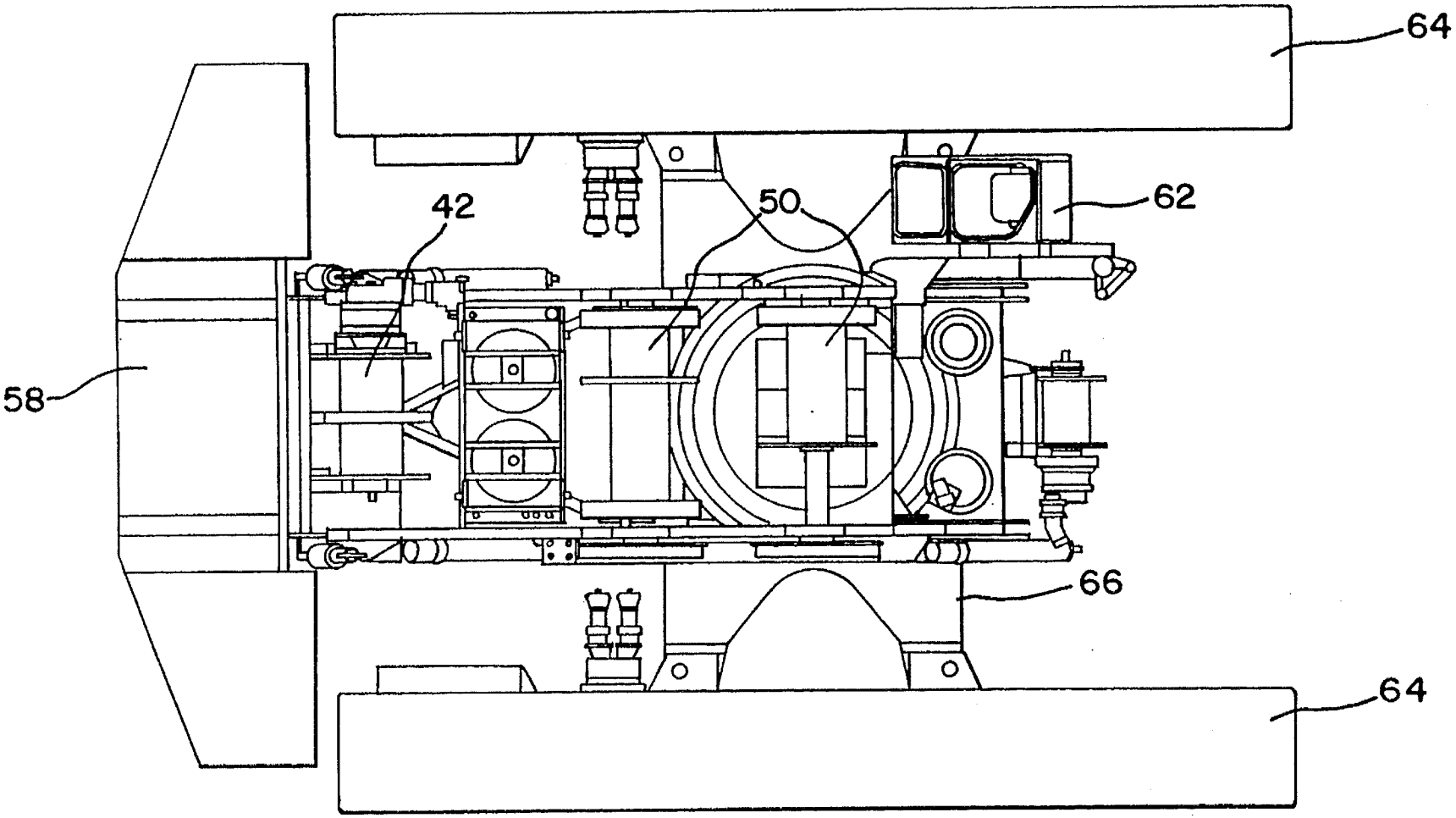
FIG. 2 is a sectional view of the crane taken along line 2—2 of FIG. 1.

While the present invention will find application in all types of cranes, the preferred embodiment of the invention is described in conjunction with the crawler crane 10 of FIG. 1 and FIG. 2. The crawler crane 10 includes an upper works 12 rotatively supported on a lower works 14 by a swing bearing 16. The upper works 12 includes a lower boom butt 20, an upper boom butt 22, a boom top 24, a boom butt cylinder 26, a boom backstop 28, a boom backstop cylinder 30, a plurality of boom sheaves 32, a gantry 34, a gantry lifting cylinder 36, a telescopic backhitch 38, backhitch pins 40, a boom hoist drum 42, boom hoist rigging 44, an equalizer 46, a plurality of pendants 48, one or more load hoist drums 50, one or more load hoist lines 52, a wire rope guide 54, a hook block 56, a counter weight 58, power equipment (not shown) enclosed by a housing 60 and an operator's cab 62. The lower works 14 includes two independently powered crawlers 64 and a car body 66.

The preferred method for self-disassembling the crawler crane 10 of the preferred embodiment is best seen by referring to FIGS. 1 through 18 and the description above.

Figure 3:
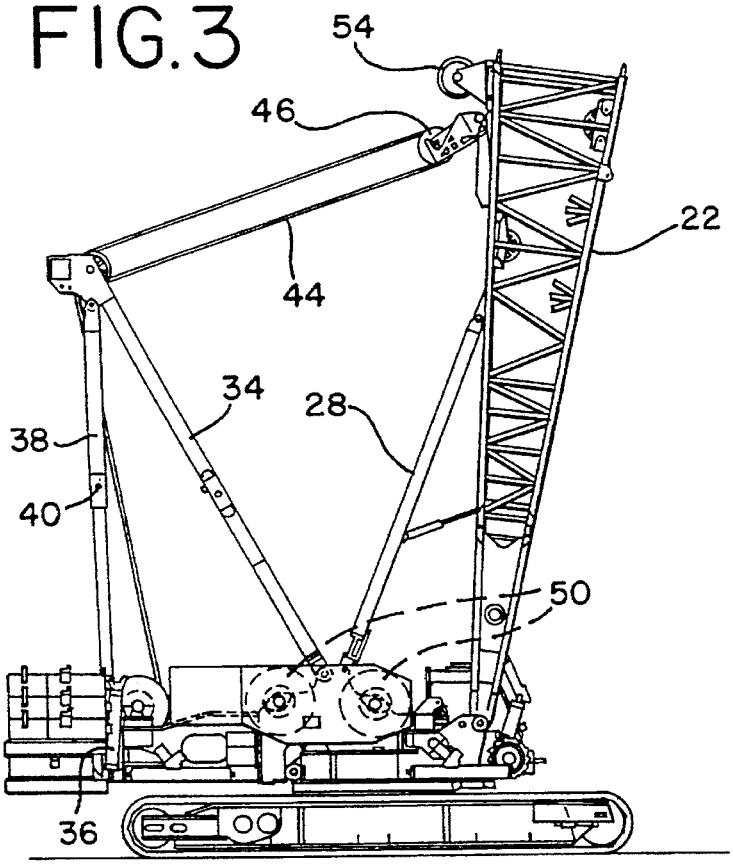
FIGS. 3 through 6 are right side perspective views of the crane in sequential stages of upper works disassembly.

As shown in FIG. 1 and FIG. 3, the boom top 24 is lowered onto the ground by extending the boom hoist rigging 44. The hook block 56 is then derigged and removed.

A load hoist line 52 is then wrapped around the wire rope guide 54 and connected to the equalizer 46. The pendant 48 is then disconnected and removed from between the boom top 24 and the equalizer 46. The boom top 24, and any boom inserts (not shown), can then be disconnected from the upper boom butt 22 and removed. The equalizer 46 is then pinned to the upper boom butt 22. The upper boom butt 22 is then raised by retracting the boom hoist rigging 44 until the boom backstop 28 is engaged.

Figure 4:
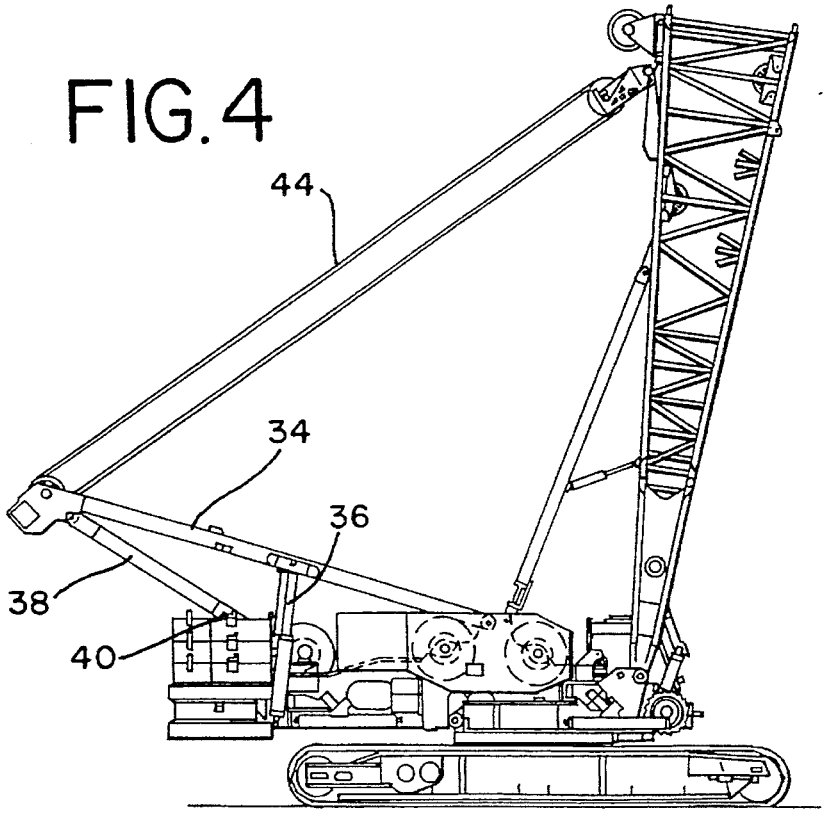

As shown in FIG. 4, the gantry lifting cylinders 36 are extended. The backhitch pins 40 are then retracted to permit the telescopic backhitch 38 to collapse. The gantry 34 is then lowered and the telescopic backhitch 38 is collapsed by extending the boom hoist rigging 44 until the gantry 34 comes to rest on, and is supported by, the gantry lifting cylinders 36.

Figure 5:
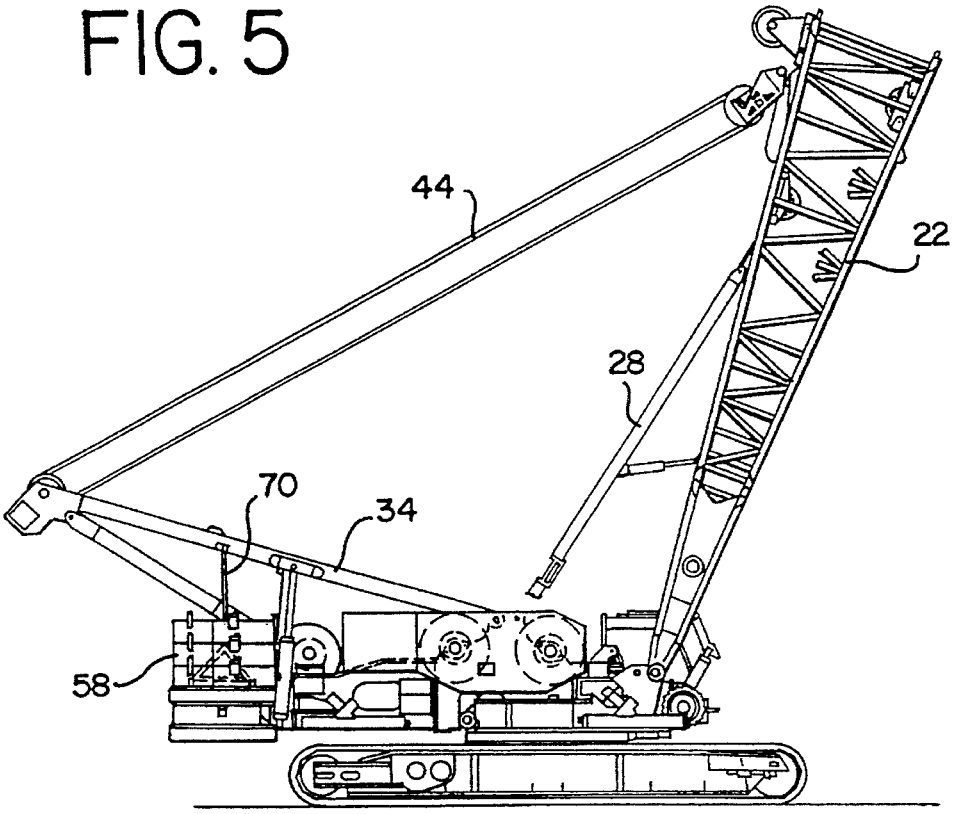

As shown in FIG. 5 the upper boom butt 22 is lowered by extending the boom hoist rigging 44 so as to disengage the boom backstop 28. A counter weight pendant 70 is then attached between the gantry 34 and the counter weight 58.

Figure 6:
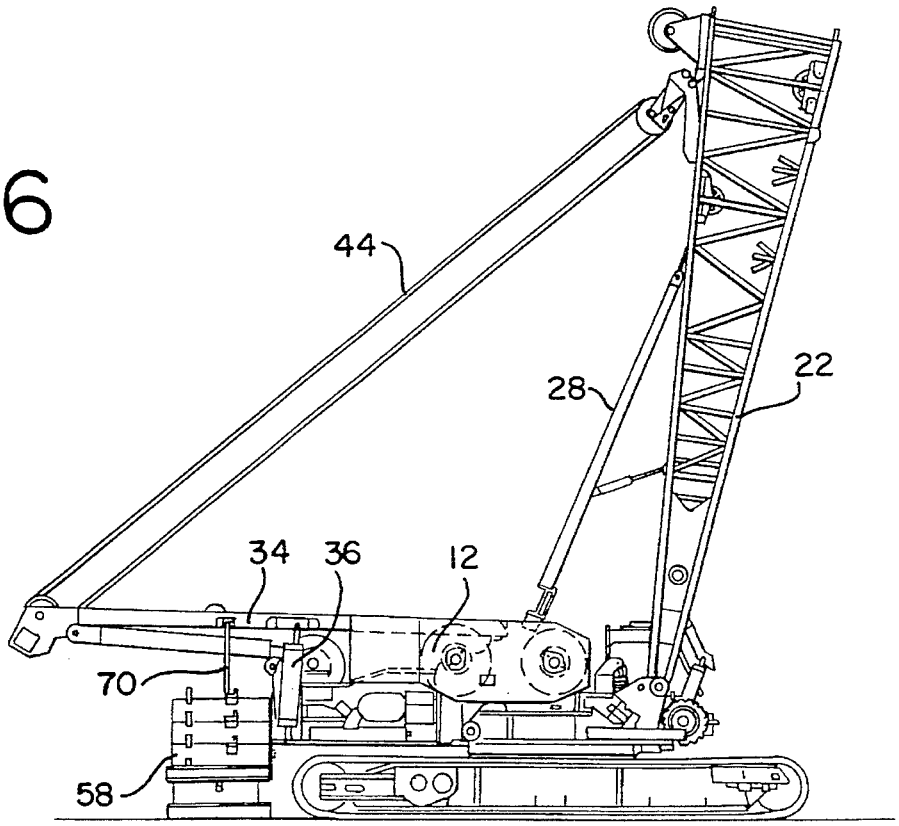

As shown in FIG. 6, the counter weight 58 is disconnected from the upper works 12 and suspended by the counter weight pendant 70. The gantry lifting cylinders 36 are then retracted so as to lower both the gantry 34 and the suspended counter weight 58 until the counter weight 58 is placed onto the ground. The counter weight 58 and the counter weight pendant 70 can then be removed.

Figure 7:
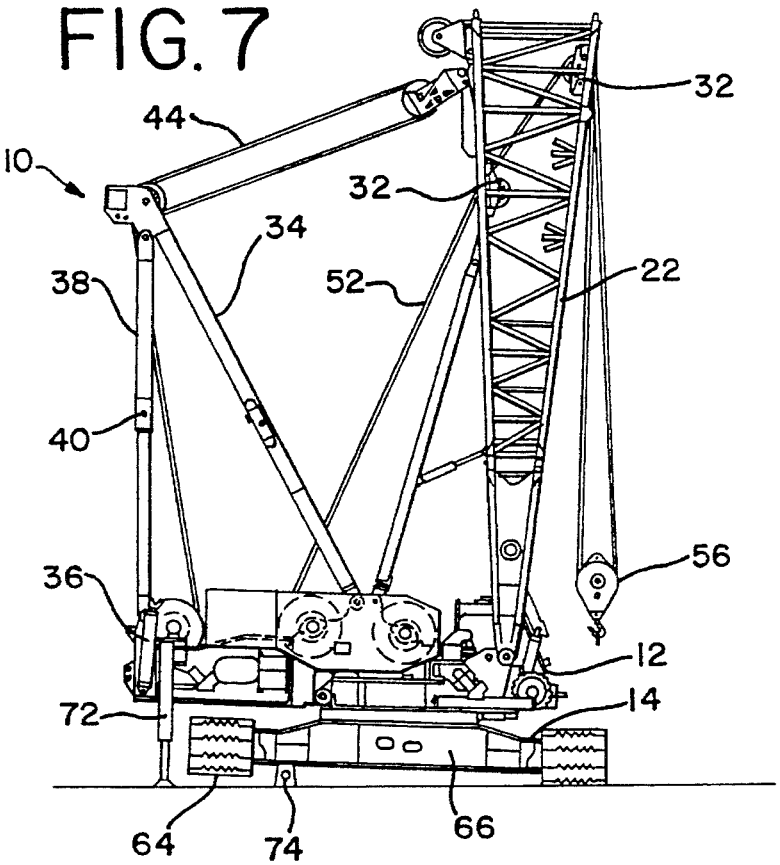
FIGS. 7 through 10 are front perspective views of the crane in sequential stages of crawler disassembly.

As shown in FIG. 7, the gantry lifting cylinder 36 is fully extended to raise the gantry 34. The boom hoist rigging 44 is then contracted to pull the gantry 34 and the telescopic backhitch 38 to full-up position. The backhitch pins 40 are then extended to lock the telescopic backhitch 38 in the extended position. The hook block 56 is then rerigged using a load hoist line 52 through the boom sheaves 32.

The crane 10 can now be used to load the previously removed components onto their transport trailers (not shown).

Referring again to FIG. 7, the upper works 12 is then rotated so that the upper works 12 is perpendicular to the lower works 14. The rear jacking cylinders 72 are then deployed. The rear jacking cylinders 72 are then extended to raise the crawler 64 adjacent to the rear jacking cylinders 72 off the ground. The car body 66 adjacent to the raised crawler 64 is rested on supports 74.

Figure 8:
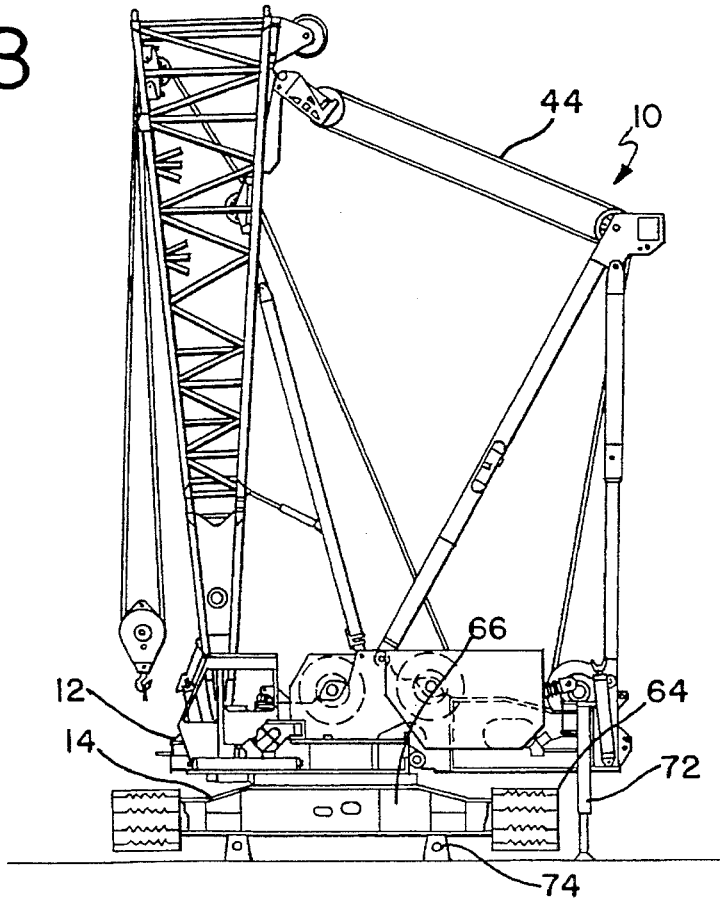

As shown in FIG. 8, the upper works 12 is rotated 180 degrees. The rear jacking cylinders 72 are then redeployed. The rear jacking cylinders 72 are then extended to raise the remaining crawler 64 off the ground. Additional supports 74 are placed under the car body 66 to completely support the crane 10 off of the ground.

Figure 9:
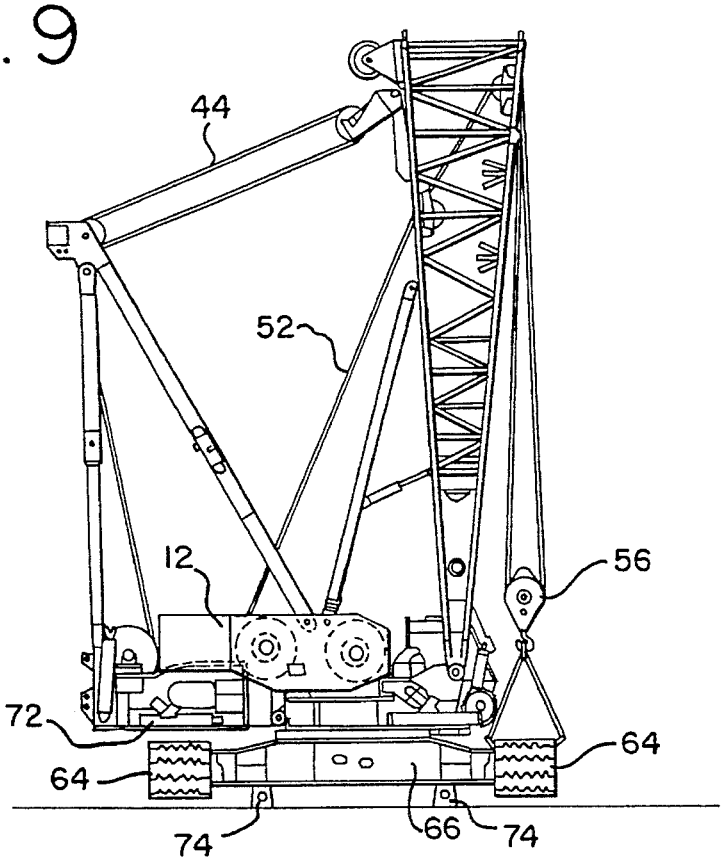
Figure 10:
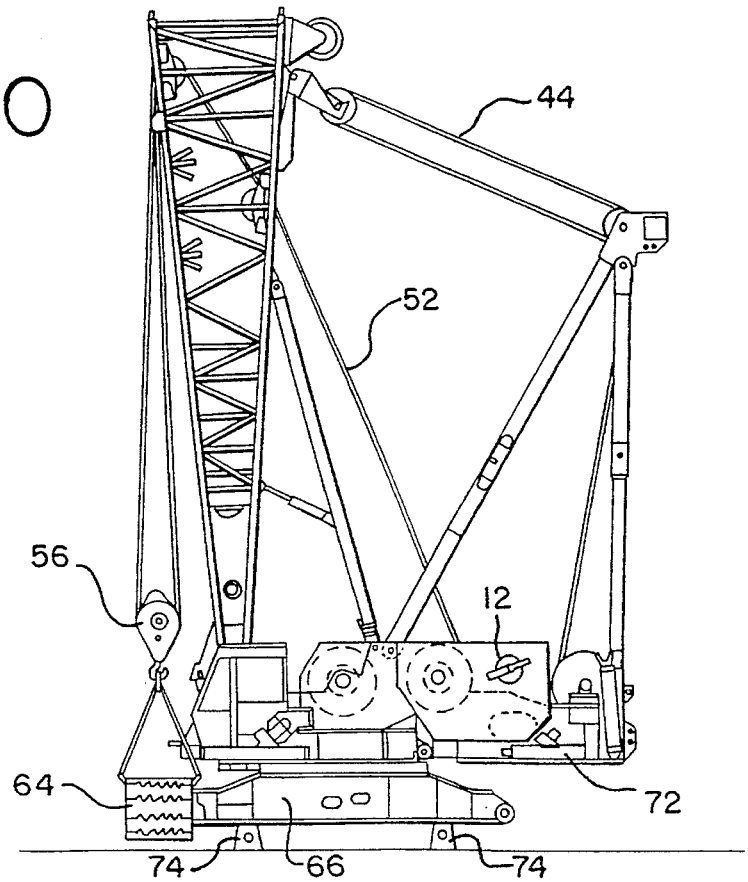

As shown in FIG. 9 and FIG. 10, the rear jacking cylinders 72 are then stored along the sides of the upper works 12. Each crawler 64 is then rigged, hooked and removed from the car body 66 and loaded onto its transport trailer (not shown). A method and apparatus for disassembling the crawlers 64 from the car body 66 are disclosed in the aforementioned application entitled "Carbody to Crawler Connection," Ser. No. 07/762,764.

Figure 11:
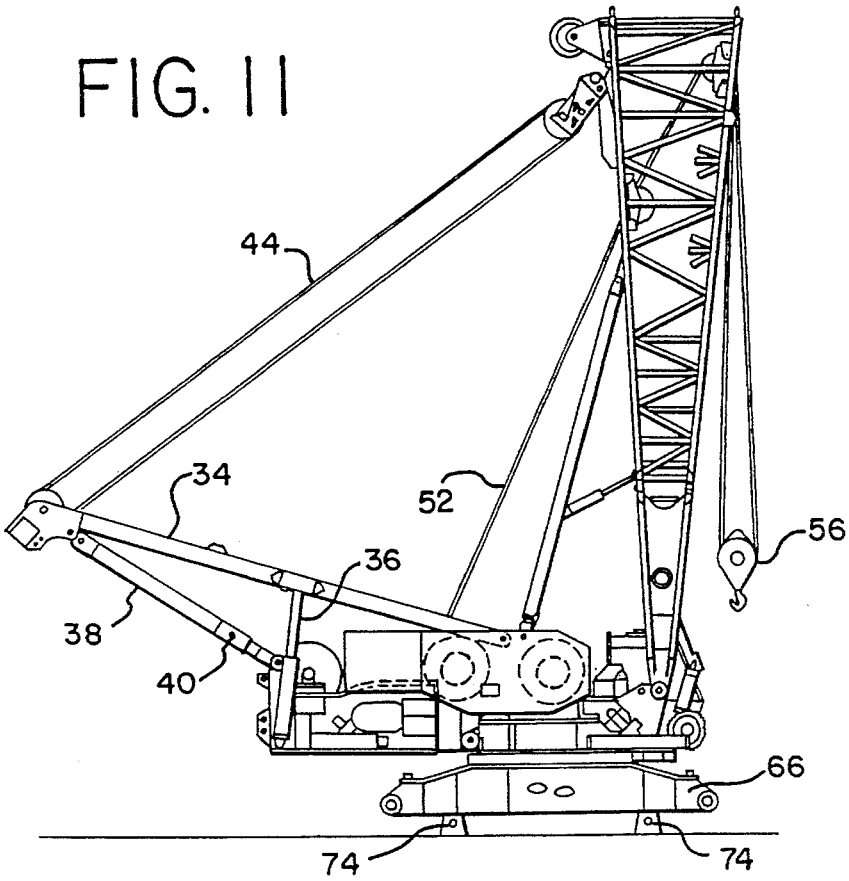
FIGS. 11 through 14 are right side perspective views of the crane in sequential stages of upper works disassembly.

As shown in FIG. 11, the gantry lifting cylinders 36 are once again extended. The backhitch pins 40 are then retracted to permit the telescopic backhitch 38 to collapse. The gantry 34 is then lowered and the telescopic backhitch 38 is collapsed by extending the boom hoist rigging 44 until the gantry 34 comes to rest on, and is supported by, the gantry lifting cylinders 36.

Figure 12:
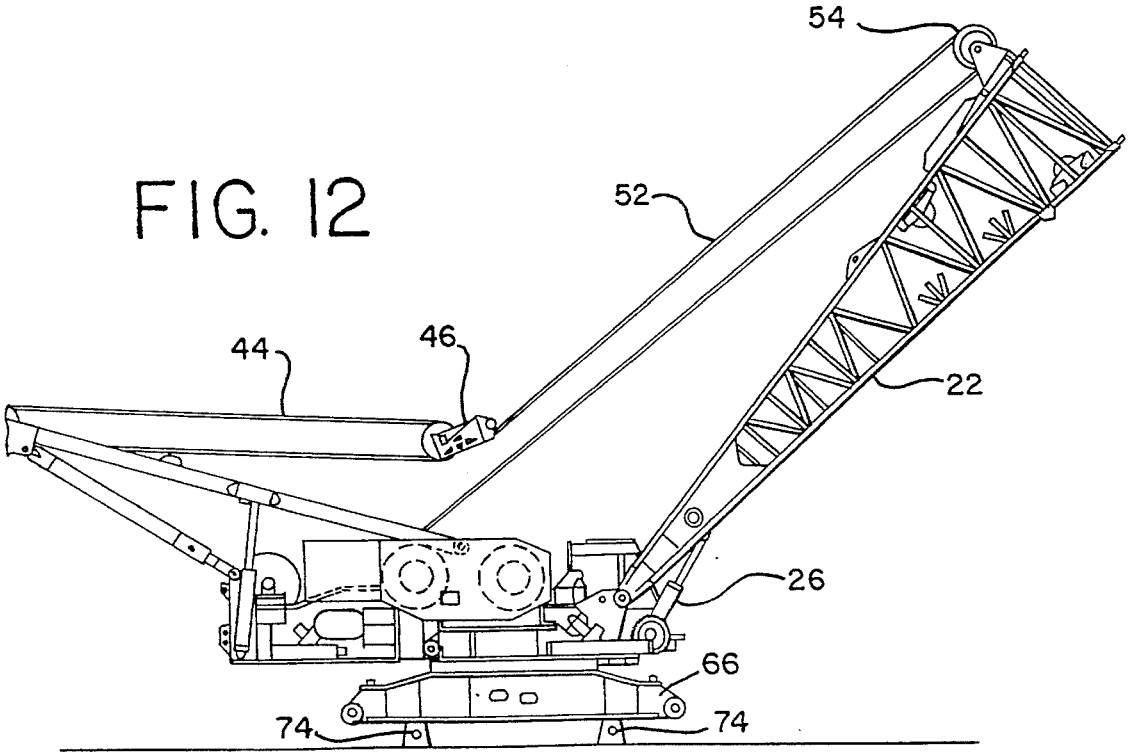

As shown in FIG. 12, the upper boom butt 22 is lowered onto the ground by extending the boom hoist rigging 44. The hook block 56 is then derigged and removed. A load hoist line 52 is then wrapped around the wire rope guide 54 and connected to the equalizer 46. The equalizer 46 is then disconnected from the upper boom butt 22. The boom butt cylinder 26 is then extended to raise the upper boom butt 22 off the ground. The equalizer 46 is then suspended by the load hoist line 52.

Figure 13:
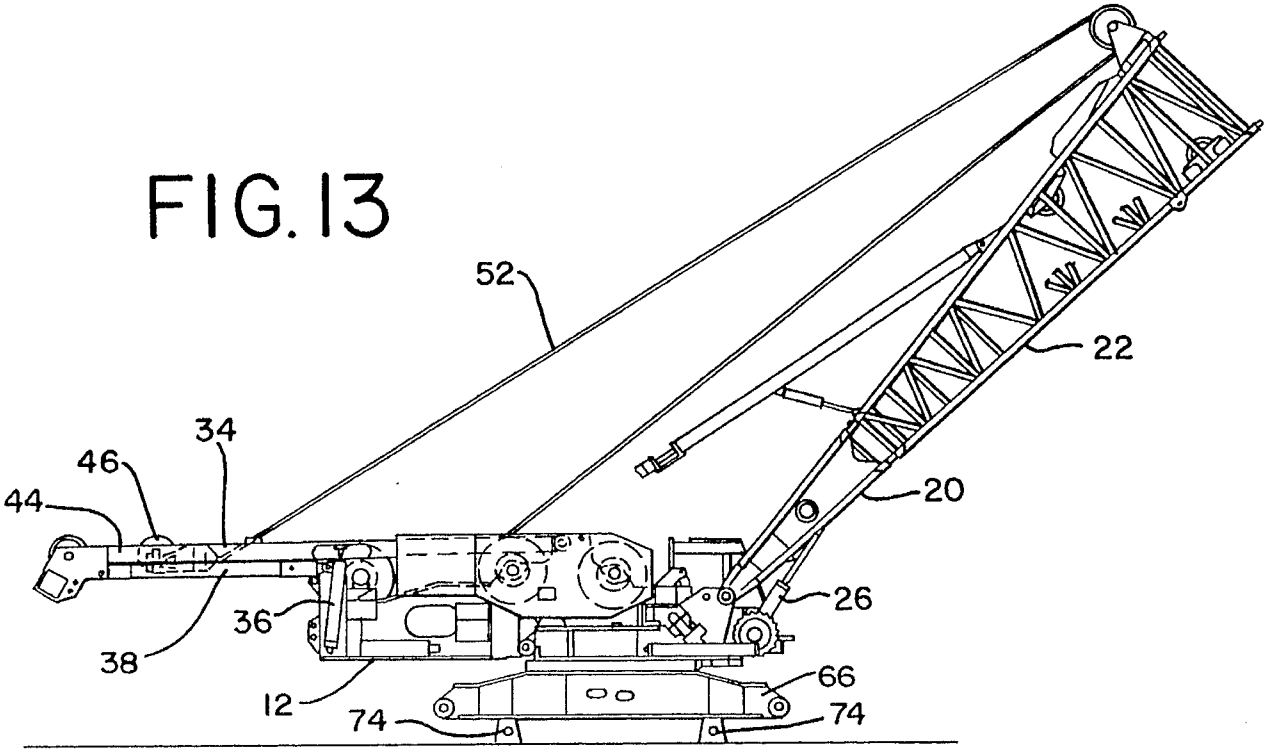

As shown in FIG. 13, the load hoist line 52 is payed out as the boom hoist rigging 44 is retracted so as to rest the equalizer 46 on the end of the gantry 34. The gantry lifting cylinder 36 is then retracted to lower the gantry 34 and the telescopic backhitch 38 onto 6he upper works 12.

Figure 14:
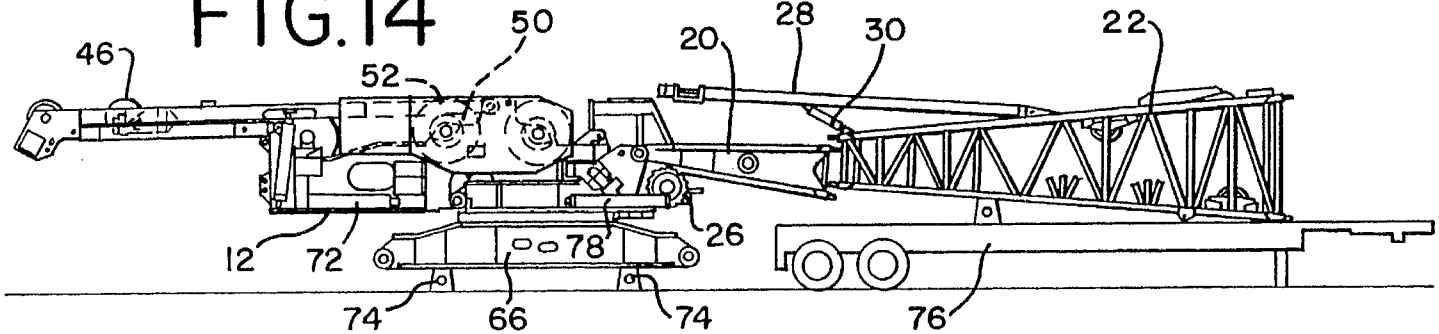

As shown in FIG. 14, the load hoist line 52 is unpinned from the equalizer 46 and wound on the load hoist drum 50. The boom butt cylinder 26 is then retracted so as to lower the upper boom butt 22 onto a transport trailer 76. The boom backstop cylinder 30 is then retracted so as to lower the boom backstop 28 onto the upper boom butt 22. The upper boom butt 22 can then be disconnected from the lower boom butt 20 and removed.

Figure 15:
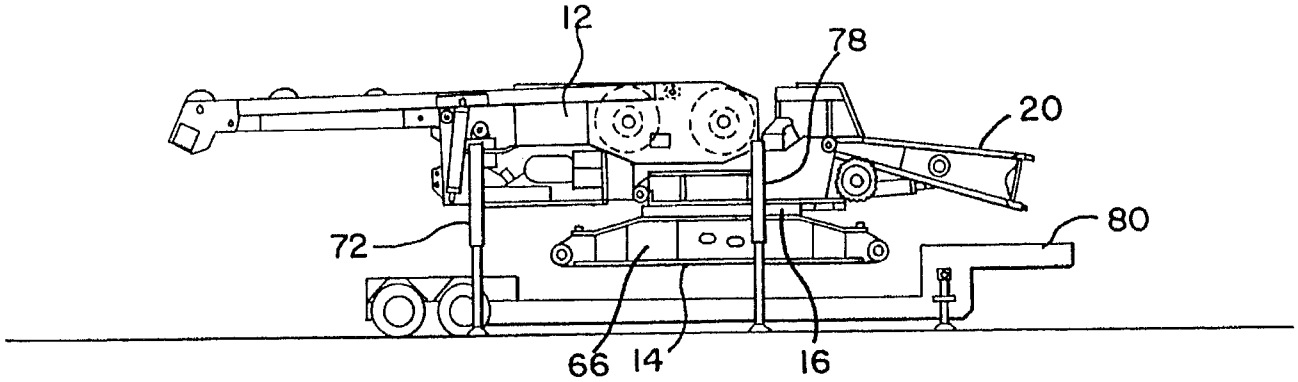
FIGS. 15 and 16 are right side perspective views of the crane in sequential stages of upper works to lower works undecking.

As shown in FIG. 15, the rear jacking cylinders 72 and the front jacking cylinders 78 are deployed. The rear jacking cylinders 72 and the front jacking cylinders 78 are then extended to raise the upper works 12 and the lower works 14 above the ground. The supports 74 then can be removed. A transport trailer 80 is then backed in under the lower works 14.

Figure 16:
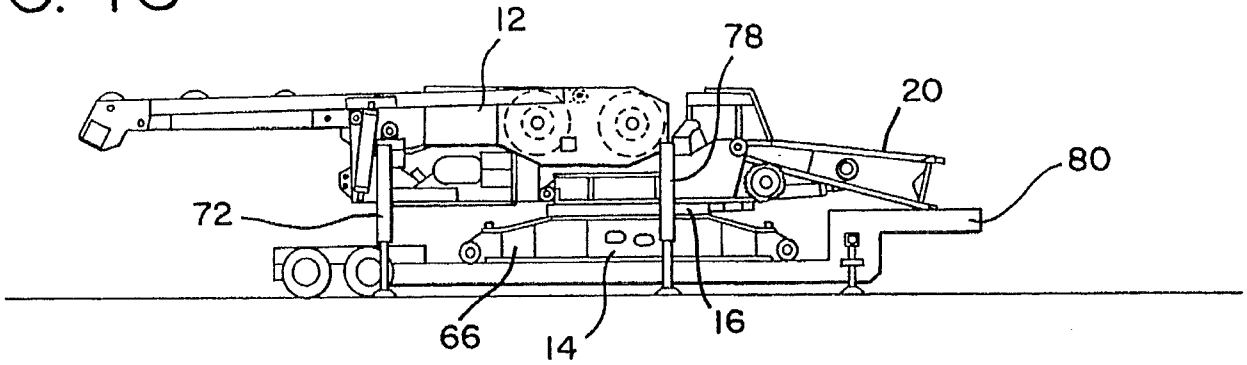

As shown in FIG. 16, the rear jacking cylinders 72 and the front jacking cylinders 78 are then contracted so as to lower the lower works 14 onto the transport trailer 80. The upper works 12 is then undecked from the lower works 14. A method and apparatus for undecking the upper works 12 from the lower works 14 are disclosed in the aforementioned application entitled "Crane Upper Works to Lower Works Alignment System," Attorney Docket No. 3380/58.

The rear jacking cylinders 72 and the front jacking cylinders 78 are then extended so as to raise the upper works 12 above the lower works 14. The lower works 14 can then be removed by the transport trailer 80.

Figure 17:
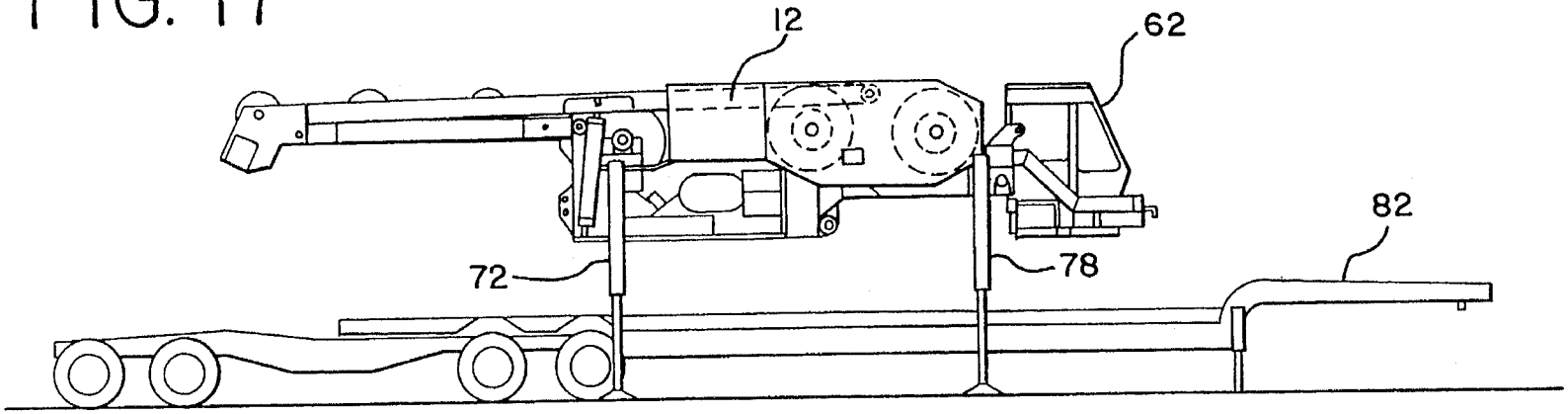
FIGS. 17 and 18 are right side perspective views of the crane upper works being loaded onto a transport trailer.

As shown in FIG. 17, a transport trailer 82 is backed in underneath the upper works 12.

Figure 18:
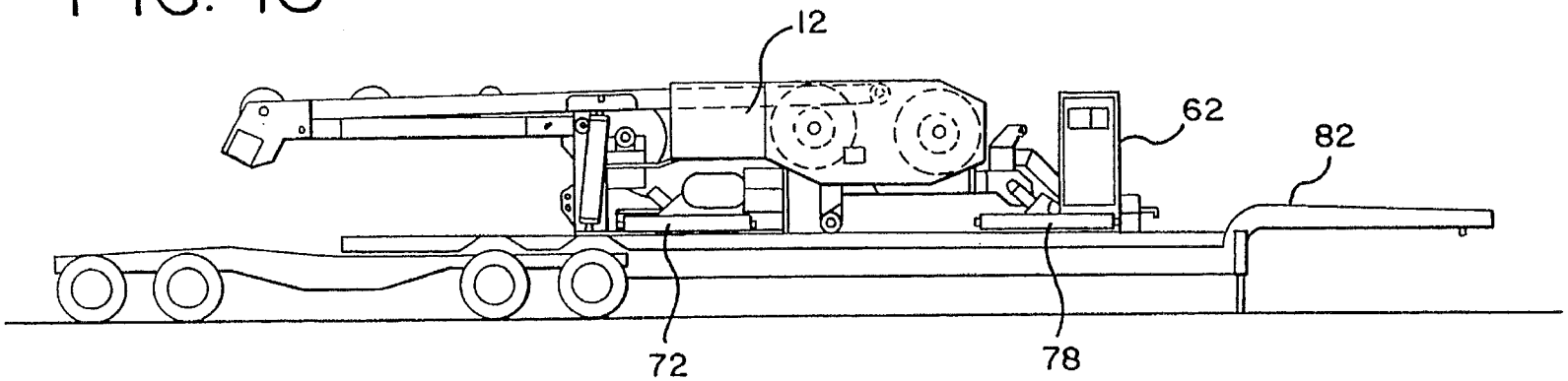

As shown in FIG. 18, the operator's cab 62 is then swung in front of the upper works 12. The rear jacking cylinders 72 and the front jacking cylinders 78 are contracted so as to lower the upper works 12 onto the transport trailer 82. The rear jacking cylinders 72 and the front jacking cylinders 78 are then stored on the upper works 12.

The individual components of the disassembled crawler crane 10 can now be transported to a new job site where it can be reassembled. Self-reassembly of the crawler crane 10 is accomplished by following the method described above in reverse order.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

I claim:

1. A process of disassembling a crane comprising a load hoist line, a boom, an equalizer, boom hoist rigging, and a hydraulic cylinder, said boom being supported by said equalizer and boom hoist rigging comprising the steps of:

a) disconnecting the equalizer from the boom;

b) connecting the load hoist line to the boom and the equalizer;

c) using the boom hoist rigging to move the equalizer to a storage position; and d) using the hydraulic cylinder to support the boom at least some time during the step of moving the equalizer to the storage position.

2. The process of claim 1 wherein the equalizer remains connected to the boom hoist rigging after the crane has been disassembled for transport.

3. The process of claim 1 wherein said load hoist line is used to suspend said equalizer at some time during the step of moving said equalizer to said storage position.

4. The process of claim 1 wherein the boom comprises a boom butt and the step of disconnecting the equalizer in step a) comprises disconnecting the equalizer from the boom butt.

5. The process of claim 1 wherein the boom comprises a boom top and a boom butt and the step of disconnecting the equalizer in step a) comprises disconnecting the equalizer from the boom top, and the process further includes the intermediate step of connecting the equalizer to the boom butt.

6. The process of claim 1 wherein the crane further comprises a gantry and in step c) the equalizer in said storage position is stored on the gantry.

7. A process of disassembling a crane comprising pendants, an equalizer, boom hoist rigging, a gantry, a load hoist line, a boom, and a boom support means, said boom supported by said pendants which are connected between the boom and the equalizer which is connected to boom hoist rigging, wherein the process comprises the steps of:

a) connecting the load hoist line to the boom and the equalizer;

b) disconnecting the equalizer from the pendants;

c) using said boom hoist rigging to move the equalizer to a storage position on the gantry;

d) using said load hoist line to suspend the equalizer during the step of moving the equalizer to said storage position; and e) supporting the boom by said boom support means during the step of moving the equalizer to said storage position.

8. The process of claim 7 wherein the boom comprises a boom butt, and the crane comprises other detachable components and after steps a) and b) the process comprises the steps of:

i) connecting the equalizer to the boom butt;

ii) disconnecting the load hoist line from the equalizer;

iii) using the boom hoist rigging and the equalizer to pivot the boom butt during removal of the other detachable crane components;

iv) reconnecting the load hoist line to the equalizer; and v) disconnecting the equalizer from the boom butt.

9. The process of claim 7 wherein the boom support means is a hydraulic cylinder.

10. The process of claim 7 wherein the equalizer remains connected to the boom hoist rigging after the crane has been disassembled for transport.

11. A process of disassembling a crane comprising pendants, an equalizer, boom hoist rigging, a gantry, a load hoist line, a boom, and a boom positioning means, the boom being supported by said pendants, the pendants being connected between the boom and said equalizer, the equalizer being connected to said boom hoist rigging, wherein the process comprises the steps of:

a) connecting the load hoist line to the boom and the equalizer;

b) disconnecting the equalizer from the pendants;

c) using said boom positioning means to position the boom and the load hoist line such that the equalizer is suspended by the load hoist line; and d) using said boom hoist rigging to move the equalizer to a storage position on the gantry.

12. The process of claim 11 wherein the boom positioning means is a hydraulic cylinder.

13. The process of claim 11 wherein the equalizer remains connected to the boom hoist rigging after the crane has been disassembled for transport.

14. The process of claim 11 wherein the boom comprises a boom butt and after step b) the process further includes the intermediate step of connecting the equalizer to the boom butt.

15. The process of claim 11 wherein the boom comprises a boom butt, and the crane comprises other detachable components and after steps a) and b) the process comprises the steps of:

i) connecting the equalizer to the boom butt;

ii) disconnecting the load hoist line from the equalizer;

iii) using the boom hoist rigging and the equalizer to pivot the boom butt during removal of the other detachable crane components;

iv) reconnecting the load hoist line to the equalizer; and v) disconnecting the equalizer from the boom butt.

* * * * *

UNITED STATES PATENT AND TRADEMARK OFFICE

CERTIFICATE OF CORRECTION

PATENT NO. : 5,484,069

DATED : January 16, 1996

INVENTOR(S) : John M. Lanning

It is certified that error appears in the above-indentified patent and that said Letters Patent is hereby corrected as shown below:

In column 2, lines 33-34, delete "07/62,766" and substitute --07/762,766--.

In column 3, line 16, after "FIG. 5" insert --,--.

In column 4, line 12, delete "6he" and substitute --the--.

Signed and Sealed this

Twelfth Day of November, 1996

Bruce Lehman

*Attest:*

BRUCE LEHMAN

*Attesting Officer*

*Commissioner of Patents and Trademarks*